US006171642B1

(12) United States Patent
Kustermann

(10) Patent No.: US 6,171,642 B1
(45) Date of Patent: Jan. 9, 2001

(54) METHOD AND APPARATUS FOR DETECTING AND CORRECTING AN OPERATING PARAMETER DURING FIBER WEB COATING

(75) Inventor: Martin Kustermann, Heidenheim (DE)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/229,089

(22) Filed: Jan. 8, 1999

(30) Foreign Application Priority Data

Jan. 14, 1998 (DE) ..... 198 01 140

(51) Int. Cl.[7] ..... B05D 3/14; B05C 11/00

(52) U.S. Cl. ..... 427/8; 427/10; 427/356; 118/665; 118/712; 118/713; 118/126; 118/410; 118/413

(58) Field of Search ..... 118/665, 712, 118/713, 410, 413, 126; 427/8, 10, 356

(56) References Cited

U.S. PATENT DOCUMENTS

| | | | | |
|---|---|---|---|---|
| 4,309,960 | * | 1/1982 | Waldvogel | 118/665 |
| 4,732,776 | | 3/1988 | Boissevain | 427/10 |
| 4,804,556 | | 2/1989 | Leffew et al. | 427/9 |
| 5,162,131 | | 11/1992 | Rantanen et al. | 427/10 |
| 5,455,422 | | 10/1995 | Anderson et al. | 250/341.1 |
| 5,529,629 | | 6/1996 | Beisswanger | 118/665 |
| 5,646,737 | | 7/1997 | Levarlet et al. | 346/429 |
| 5,785,253 | * | 7/1998 | Ueberschar et al. | 239/455 |
| 6,010,739 | | 1/2000 | Ueberschar et al. | 427/8 |

FOREIGN PATENT DOCUMENTS

| | | |
|---|---|---|
| 37 36 265 A1 | 5/1989 | (DE) . |
| 37 36 293 A1 | 5/1989 | (DE) . |
| 37 41 680 A1 | 6/1989 | (DE) . |
| 36 38 932 C2 | 8/1990 | (DE) . |
| 39 08 386 A1 | 9/1990 | (DE) . |
| 40 15 017 A1 | 11/1991 | (DE) . |
| 41 33 439 A1 | 4/1992 | (DE) . |
| 41 06 313 A1 | 9/1992 | (DE) . |
| 42 35 824 A1 | 2/1994 | (DE) . |
| 42 29 267 A1 | 3/1994 | (DE) . |
| 42 06 776 C2 | 1/1996 | (DE) . |
| 195 01 346 A1 | 7/1996 | (DE) . |

(List continued on next page.)

OTHER PUBLICATIONS

"Modern Free–jet Coating Heads for LWC and MWC Coating," *Voith Sulzer Paper Technology*, May, 1998.

"Beschichten textiler Trägerbahnen," by Günter M. Milles, *Coating*, Dec., 1994. (no month date).

"Modernisierung von Beschichtungsanlagen unter wirtschaftlichen, technisch–technologischen und ökologischen Aspekten", Michael Schmalz, *Coating*, Jan. 1995.

*Primary Examiner*—Katherine A. Bareford
(74) *Attorney, Agent, or Firm*—Taylor & Aust, P.C.

(57) ABSTRACT

In a method of direct or indirect application of a liquid or viscous coating medium onto a moving material web, specifically a paper or cardboard web, a layer of the coating medium is applied to the material web by use of an applicator unit. The coating result is then checked for deviations from the desired coating result. In the event that such deviations are detected, and in order to correct them, at least one applicator unit operating parameter is adjusted. The adjustment is made within a short time period, and with the material web running, from an initial operating parameter value that is in effect prior to detection of the deviation. Subsequently, the operating parameter is then reset to at least approximately the initial parameter value, whereby the adjustment and the subsequent resetting may be repeated if necessary. With this method, particularly with a free jet applicator, streaking in the coating profile of the applied layer, caused by dirt particles or other contaminations which have deposited themselves in the jet discharge opening of the free jet applicator, may be eliminated.

28 Claims, 1 Drawing Sheet

FOREIGN PATENT DOCUMENTS

| | | | |
|---|---|---|---|
| 195 28 519 A1 | | 2/1997 | (DE) . |
| 2 252 926 | * | 8/1992 | (GB) . |
| 2 265 846 | | 10/1993 | (GB) . |
| 2 289 941 | | 12/1995 | (GB) . |
| 2 297 616 | | 8/1996 | (GB) . |
| WO 91/10891 | | 7/1991 | (WO) . |
| WO 94/02806 | | 2/1994 | (WO) . |

* cited by examiner

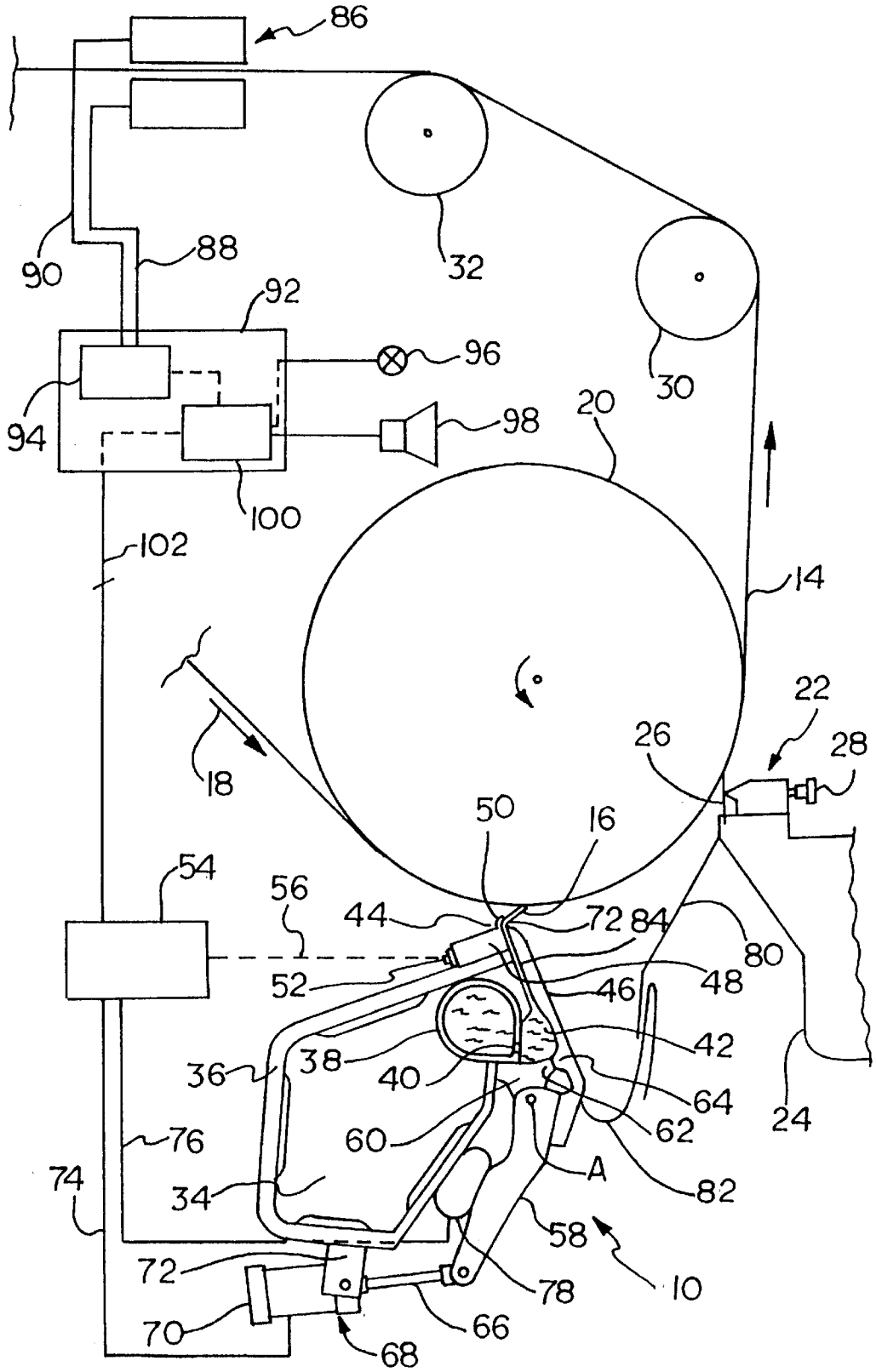
86
90
88
92
32
30
96
94
98
20
100
102
14
22
26
28
18
50
16
54
56
44
72
84
80
52
46
48
42
36
38
40
64
62
24
60
76
A
74
34
82
58
72
78
10
70
66
68

METHOD AND APPARATUS FOR DETECTING AND CORRECTING AN OPERATING PARAMETER DURING FIBER WEB COATING

BACKGROUND OF THE INVENTION

1. Field of the Invention

The present invention relates to a method for direct or indirect application of a liquid or viscous medium onto a moving material web, specifically a paper or cardboard web.

2. Description of the Related Art

In the paper producing industry, coating mediums are applied in the thickness range of one micrometer when applying coating or glue. The coating mediums take the form of glue, starch substance, pigment medium or conventional coating ink. It is very important that the layers applied to the paper web display a uniform profile, both in cross direction and in longitudinal direction in order to meet the high quality requirements put on paper by the paper manufacturer's customers and end users. A multitude of factors influence the thickness and quality of the applied layers. It is therefore easily understandable that, with conventional paper web widths of 10 m or wider, conventional machine speeds of up to 2000 m/min. or higher, and the associated large machinery required for paper production, disturbing factors may arise which would have a negative influence upon the coating result. These factors would include temperature related deformations of machinery components, mechanical wear and tear of doctoring elements, fluctuations of consistency of the coating medium, contaminations, etc. In order to gain control over these disturbing influences, modern paper production lines are equipped with sophisticated electronics which conduct measurements at many different locations within the production sequence. On the basis of these measurements, a control center, usually a process computer, triggers suitable control elements through which a targeted control can be exercised over the individual operating parameters of the machines. For example, it is quite common to measure the actual cross profile of the applied coating layer and, in the event of unevenness in the coating profile, to regulate the contact pressure and/or the angle of attack of a doctoring element by adjusting screws or hydraulic actuators.

All previously known solutions for elimination of defects in the coating result, that is, elimination of fluctuations from a desired coating result, have in common that, depending on the type of adjustment, one or more operating parameters are adjusted gradually relative to the observed defect until the defect in the coating result is no longer observed. The operating parameter or parameters will then remain at the newly adjusted values until possibly another defect is observed which would make necessary further adjustments of the operating parameter or parameters. This method is effective and corresponds with well known principles of control engineering.

Disturbing factors occasionally arise in a production run whose negative effects upon the coating result cannot be eliminated by the continuous adjustment of one or several operating parameters. If dirt particles, clumps of coating medium, fluff, dust particles or pulp fibers from the paper web adhere to exposed locations on an applicator unit in a machine for paper production, for example a nozzle gap of a free jet applicator, the resulting impairments of the coating result cannot be corrected easily by gradual adjustments of appropriate operating parameters. Specifically, this is often not possible in a relatively short time period, which is why large amounts of reject paper must be expected.

SUMMARY OF THE INVENTION

The current invention is based in the technical problem to cite a method which enables a speedy correction of coating result defects, even when dealing with the aforementioned disturbing factors, resulting in a lesser amount of rejected, unusable material. A layer of the coating medium is applied to the material web by use of an applicator unit. The coating result is then checked for deviations from the desired coating result, whereby at least one applicator operating parameter is influenced in the event of such deviations being discovered.

In order to correct the deviations, at least one applicator unit operating parameter is adjusted within a short time period—with the web running—from an initial operating parameter value which is in effect prior to having noticed the deviations. If required, the adjustment process is repeated and subsequently reset at least approximately equal to the initial parameter value.

Under the method offered by the current invention, a defect that is considerably larger compared to the defect that is to be corrected is momentarily accepted, when the operating parameter is adjusted from its initial parameter value. This adjustment does not serve to reduce the observed deviation and approximation of a desired value per se, but is intended only to enable the removal of the disturbing factor. Thus, none of the defects in the coating result caused by such disturbance factors are observed any longer following the readjustment of the operating parameter to the original value.

Sufficiently strong adjustment of suitable operating parameters—such as contact pressure of a doctoring element, the flow pressure of the application medium, the opening cross profile of a discharge opening for the application medium, etc.—may, for example, allow dirt particles, fluff or clumps to be washed away and the coating medium to again be applied uniformly across the entire width of the material web. Actually, the incorrect coating caused by the short-term adjustment of the operating parameter results in a certain amount of reject. However, since fast trouble shooting is possible, this waste is extremely small compared to such adjustment procedures wherein an operating parameter is adjusted step by step in the sense of a convergency toward a desired value. An adjustment time of a few tenths of a second, as well as one of several seconds, may, for example, be viewed as a short-term adjustment of the selected operating parameter.

In the event of particularly stubborn contaminants, an appropriately longer adjustment period may be required. In each instance, the operating value is then essentially reset to its initial value, which differentiates the method of the current invention from conventional corrective measures. Since the correction of deviations is made with a moving material web, no operational shut down, which would massively increase the production costs, is necessary.

It is possible to delay the resetting of the operating parameter to its initial parameter value until the desired coating result has been achieved. Consequently, one form of the method of the current invention provides that the operating parameter, following its adjustment, is reset to the original parameter value, dependent on observing at least reduced deviations. It is then ensured that the cause of the observed deviations in the coating result has been completely removed.

Alternatively, provisions may be made that, following its adjustment, the operating parameter is reset to its original parameter value, independent of observing at least reduced deviations. Specifically, the operating parameter, following its adjustment, can be reset to the original parameter value after a predetermined time period. In this instance, it is not verified whether the adjustment of the operating parameter has already resulted in the desired result before resetting the operating parameter. If necessary, the adjustment of the operating parameter needs to be repeated if a single adjustment procedure has not achieved the desired result.

A preferred form of the operational method of the current invention provides that, when checking the coating results, the material web is checked for the presence of defective application zones in the applied layer. In such defective application zones, the coating medium has not been applied or has been applied only in insufficient quantities. Such defective application zones, for example, occur in free jet applicators and take the form of longitudinal streaking in the direction of the material web flow, when solid particles cause localized obstruction of the jet nozzle of the free jet applicator. There is almost no ink application onto the material web in these streaking zones, which is why, according to the length of these streaks, corresponding sections of the material web are rejected. In addition, these defective streak shaped application zones cause doctoring devices—possibly a doctor blade—that may be installed downstream in direction of web flow, to become excessively hot and to locally "burn up" and wear out sooner, due to the dry, non-coated background. For this reason, quick streak recognition on the coated material web is very important.

Various procedures are feasible for checking the coated web. On many types of coating, the coating result is measured by use of sensory analysis which works with radioactive radiation sources, possibly beta particle radiation. These types of measuring methods enable minor variations in the coating profile to be detected.

However, the method of the current invention utilizes an optical examination of the web, specifically for streak detection, that is for detection of streak-shaped longitudinal zones in the web in which little or no coating medium has been applied. This optical examination may be carried out by the operator who, in the event of observing defective zones in the applied coating layer, makes an adjustment and, if required, subsequently restores the at least one operating parameter. The visual detection by the human eye of streak-shaped defective coating zones is possible, particularly when the color of the background, that is, the color of the raw web, differs from the color of the coating medium. This is the case, for example, when the utilized color is whiter than the carrier paper. This also enables an operator to easily and quickly detect faulty coating of the paper with the naked eye and to make corrections. But even when coating the web with a coating medium that is similar in color or almost colorless, streaks in the coating profile can be detected with the naked eye upon detailed and careful examination.

When the operator has detected a faulty application, he or she can make the adjustment of the at least one operating parameter manually, so that corrections are made directly to mechanical components of the applicator unit, for example by turning an adjustment screw or opening or closing the wall of a spray nozzle. However, many times it is possible to influence individual applicator operating parameters from a monitoring and control center with push buttons or by adjustment of sliding or rotary control elements.

A control unit, for example a microprocessor, sends appropriate control signals to positioning elements of the applicator. The opening width of the nozzle gap in a free jet applicator could be changed locally and/or universally by actuators, for example hydraulic actuators. Insofar as the detection of defects remains the responsibility of an operator, the volume of rejects will depend on how quickly the operator detects the defect and reacts to it. The operator's attention to detail, which, however, may reduce with declining concentration, is therefore a decisive factor. This is the reason that a considerable time span may possibly elapse prior to defect elimination. To provide relief to personnel, it is therefore appropriate that the web is examined by use of an optical device, the measurement data of which can then be evaluated regarding the presence of defective coating zones. Effective measuring techniques have been opacity measurements as well as reflection measurements of the coated web. Within the scope of the opacity measurement, which may also be described as transparency examination, the transparency of the coated web is determined.

It is easily understandable that the transparency of the web in those areas where little or no coating medium has been applied differs from the transparency of the areas where the coating has been applied properly. The difference in opacity may be measured by use of a sensory arrangement of light emitting transmitters on one side of the web, and light detecting receivers on the other side of the web. In the case of the reflection measurement, it is assumed that correctly coated areas of the web will display different light reflective characteristics than areas of defectively applied coating layers. The measuring device in this instance includes a sensoring device including light emitting and light detecting components on the same side of the web.

Provisions may be made that the data provided by the measuring device, possibly after suitable processing, is indicated by a display unit and can then be evaluated by an operator who, in the event of detected defective coating areas, will make the adjustment and, if required, subsequently restore the at least one operating parameter. It is feasible, for example, to display the measuring data graphically on a screen of the control center. If an operator then interprets the measuring results displayed on the screen as to the presence of undesirable defective coating zones, he or she will instigate the necessary corrective measures. These may again include direct manual intervention on mechanical applicator components, or may include operational procedures in the control unit.

Even though, in this form of the method of the invention, the personnel is relieved of the arduous and error-prone examination of the coated web through the naked eye, thereby already providing an increase in efficiency, the time lapse unit defect removal still depends on how carefully and conscientiously the indicated measurement data is interpreted and acted upon by the operating personnel. A further simplification in the operating personnel's activities and a step toward automation of the operating sequences could be to evaluate the data provided by the measuring device with regard to the presence of defective coating zones, by preferably a microprocessor-supported analyzer.

The possibility then exists that the analyzer's evaluation results are communicated to an operator and that the operator, in the event of defective coating zones in the applied layer having been detected, makes the adjustment and, if required, subsequently resets the at least one operating parameter. It is, for example, feasible that when defective application zones are detected in the coating layer, optical and/or audible warnings are provided for the operator. An operator who continuously concerns himself with monitoring the web with regard to the occurrence of streak-shaped defective application zones is then unnecessary. It is sufficient to have an operator who is engaged with other control functions, and intervenes when a warning is detected. Other than that, the automatic measurement and evaluation can progress unattended, which has a positive effect on personnel expenditure.

A complete automation of defect recognition and defect removal can be achieved by coupling an analyzer with a control unit which, in the event of detecting defective application zones in the coating layer, triggers the adjustment and subsequent restoration of the at least one operating parameter. The control unit, which may, for example, be implemented by a host processor, controls appropriate control elements when required, through which the operating parameter or parameters which need to be adjusted can be controlled. The host processor may at the same time serve as the analyzer, so that evaluation of the measured data and execution of correction can be combined as far as hardware is concerned. The thereby created control circuit also permits automated defect treatment and removal which can be accomplished quickly and reliably. This permits maximum efficiency which, in the event of defective coating zones, results in only very low volumes of material rejects.

A preferred embodiment of the invention provides that the application unit is constructed as a free jet applicator. The coating medium is directed in the form of a jet through a jet discharge opening in the applicator, either directly onto the material web or onto a running transfer surface for indirect application from which it is subsequently transferred to the material web. For corrections of fluctuations, at least one operating parameter affecting the jet characteristics, specifically the jet shape, is adjusted. As already mentioned, a local obstruction of the jet discharge opening could occur in which dirt particles or clumps of coating medium deposit themselves in the jet discharge opening that forms the jet nozzle. In order to remove such obstructions, it is feasible to increase the jet pressure for a short time period to push the obstruction out of the jet discharge opening. It is also feasible to let the jet pulsate in order to break away the obstruction with pressure thrusts.

The flow volume of the coating medium could also be altered for a short period of time in order to thereby achieve a loosening effect of the obstruction. A preferred design, in contrast, provides that, in order to correct the deviation, the opening cross profile of the jet discharge opening is enlarged and subsequently again reduced from the enlarged value. By enlarging the cross profile of the jet discharge opening, the obstruction can be washed from the jet discharge opening by the coating medium which continues to flow through the jet discharge opening. When the opening cross profile of the jet discharge opening is subsequently again adjusted to its original value, the conditions for a defect free application are reestablished.

As a rule, it is sufficient to locally increase the opening width of the jet discharge opening for the purpose of enlarging the opening cross section—when viewed transversely to the direction of web flow—in areas of observed deviation from the desired coating result. Prerequisite for this is that the jet discharge opening can be adjusted locally at its opening side, for example with the help of adjustment screws or through the operation of hydraulic actuators. However, it is also possible to enlarge the opening cross section of the jet discharge opening by enlarging its opening width substantially across its entire length of the jet discharge opening, measured transversely to the direction of the web flow or the transfer area. To this end, a jet nozzle having a discharge opening could, for example, be opened along its entire length for a short time period, and then be closed again.

A device especially suitable for carrying out the previously described process for direct or indirect application of a liquid or viscous coating medium onto a moving material web, specifically a paper or cardboard web, should also be independently protected within the scope of the invention. The device includes an applicator unit to coat the material web with a layer of coating medium, a measuring device to obtain data regarding the coating result on the coated web, as well as a microprocessor-supported analyzer if required, to evaluate the obtained data with a view to deviations of the measured coating result from the desired coating result.

The invention provides that in such a device:

a) the analyzer is coupled with a control unit which, in the event of detecting deviations between the measured and the desired coating result, produces correction of such deviations by short term and possibly repeated adjustment of at least one coating unit operating parameter—with a moving material web—from an initial operating parameter value which is in effect prior to having noticed the deviations, and is then reset at least approximately to the initial parameter value; and b) the analyzer is coupled with a warning device which, in the event of detecting a deviation between the measured and the desired coating result, provides an optical and/or audible warning. A preferable arrangement provides that a measuring device is configured at least partially as an optical measuring device which conducts optical measurements of the coated material web in order capture the coating results. The measuring device may be equipped for measuring opacity characteristics and/or reflection characteristics of the coated material web.

A preferable arrangement includes an analyzer for evaluation of measured data with regard to the presence of zones displaying missing or insufficient volumes of applied coating medium in the applied layer.

In a preferred embodiment of the device according to the invention, the applicator unit is as a free jet applicator having a jet discharge opening for a coating medium jet which, in the instance of direct application, is directed onto the material web and, in the instance of indirect application, is directed onto a running transfer surface. From this transfer surface—effectively the shell surface of a transfer roll—the coating medium is then transferred to the material web. Doctoring of superfluous coating medium and final metering usually occur on the transfer surface prior to the transfer of the coating medium to the material web.

When the applicator unit is a free jet applicator, it is recommended that, in the event of detection of deviations between the measured and the desired coating result, the control unit produces the adjustment of at least one applicator unit operating parameter which affects the jet characteristics, specifically the jet shape. In the event of deviation detection between the measured and the desired coating result, the control unit preferably causes a short term enlargement of the jet discharge opening's cross profile. This can be arranged so that, in the event of detection of deviations between the measured and the desired coating result, the control unit causes the short term enlargement of the opening width of the jet discharge opening—when viewed transversely to the direction of web flow, or the transfer surface—locally in areas of the observed deviation between the measured and the desired coating result.

Alternatively, in the event of detection of deviations between the measured and the desired coating result, the control unit can be configured to cause the short term enlargement of the opening width of the jet discharge opening along its entire length—when viewed transversely to the direction of web flow, or the transfer surface.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a side, schematic view of one embodiment of the device of the present invention.

The exemplification set out herein illustrates one preferred embodiment of the invention, in one form, and such exemplification is not to be construed as limiting the scope of the invention in any manner.

DETAILED DESCRIPTION OF THE INVENTION

A more detailed explanation of the invention, with the help of the enclosed single drawing, follows below. The illustration is a schematic of one embodiment of the applicator unit which in this instance takes the form of a free jet applicator, according to the invention. This free jet applicator is generally identified with 10. It dispenses a liquid or viscous medium, possibly a coating ink or a glue, in the form of an open jet from a discharge opening 12 directly onto a material web 14. The jet 16 reaches substantially continuously across the entire width of the web 14, transversely to its direction of flow 18. The material web, preferably a paper, carton or cardboard web 14, is led over a backing roll 20 in the area of the applicator unit 10. it is supplied by a parent roll from which it is unwound and which is not illustrated here, or from an upstream manufacturing station in which it is produced.

Material web 14 may run through at least one other applicator station before and/or after the applicator unit 10 if required, in which case at least one more uniform layer of the coating medium would be applied to the material web 14. After the material web 14 has passed through the mist coat of the coating medium produced by the jet 16 in the area of the applicator unit 10, and has been moistened by the medium, superfluous amounts of medium are removed from the web 14 in a doctoring area 22. The illustrated example provides a doctor blade 26 for this purpose which is held on a blade beam 24, whereby the doctor blade is in contact with the passing material web 14 at a suitable blade angle and with a suitable contact pressure. The doctor blade 26 contact pressure may be adjusted with the help of one or more positioning elements 28 (in this instance an adjustment screw). Precision metering of the previously excessively applied and only roughly pre-metered medium occurs in the doctoring area 22 to the desired coating thickness.

After passing through the doctoring area 22, the coated material web 14 is routed upward over guide rollers 30, 32 into a dryer area (not illustrated here) where the layer of the applied medium is dried, for example by use of infrared driers. The material web 14 is then led to other processing stations, if required.

The applicator unit 10 includes an elongated supporting body 34 which is accommodated in a housing 36. An ink distributing pipe 38 is held by the supporting body 34. The coating medium is pumped from one side into pipe 38. Along its length, measured transversely to the direction of travel 18 of material web 14, the ink distributor pipe 38 displays a multitude of ink supply openings 40, through which the coating medium travels from the ink distributor pipe 38 into a pre-chamber 42. Because of the pressure drop along the ink distributor pipe 38, the coating medium is pumped into the ink distributor pipe 38 with such pressure that an unused residual amount of coating medium runs off on the opposite end of the ink distributor pipe 38. This ensures that a continuous supply of fresh coating medium is also available at that end and that fresh coating medium continuously flows through the ink supply openings at that location into the pre-chamber 42.

From the pre-chamber 42 the coating medium is admitted to a jet nozzle which is generally identified with 44 and which is equipped with the jet discharge opening 12. The jet nozzle 44 is restricted by a nozzle front panel 46 and a nozzle back panel 48. In the area of the jet discharge opening 12, the rear panel 48 exhibits a bent nozzle lip 50 which causes diversion of the jet 16 that is emerging from the jet nozzle 44 at a suitable angle to the material web 14. The width of the jet nozzle 44 may be adjusted by use of one or more adjustment elements 52, specifically the distance between the nozzle lip 50 and the tip of the nozzle front panel 46. This permits desired adjustment of the jet cross profile and therefore the volume of the dispensed medium. A number of adjustment elements 52 are provided for practical purposes across the width of the material web 14 so that the width of the jet nozzle 44 can be individually adjusted locally. The adjustment elements 52 may take the form of manually adjustable adjustment screws or hydraulically or pneumatically operated actuators. In the last mentioned instance, these actuators are connected to a pressure source 54 which is only alluded to schematically. The broken line 56 shows a pressure line.

The nozzle front panel 46 is fixed to a lever arm 58 which pivots on an axle A and is mounted on a bearing support 60 of housing 36. The bearing support 60 exhibits a stop boss 62 opposite a stop projection 64 of the nozzle front panel 46. In the operational condition depicted in the illustration, the lever arm 58 is pivoted into its operating position in which the nozzle front panel 46 contacts the stop boss 62 of the bearing support 60 with its stop projection 64. A defined opening width for jet nozzle 44 is thereby established through the stop boss 62 and can be fine tuned by operating the adjustment element 52.

On the end of the lever arm 58 furthest removed from the nozzle front panel 46, a piston rod 66 of a piston cylinder unit 68 pivots. A cylinder 70 of piston cylinder unit 68 is held to the housing 36 by use of a mounting flange. The piston-cylinder unit 68 is connected to the pressure source 54 via a pressure line 74. An additional pressure line 76 runs from the pressure source 54 to a pressure tube 78 which is located between the lever arm 58 and the housing 36. It is to be understood that the pressure lines 74, 76 could be pressure line bundles, if necessary.

By operating the piston-cylinder unit 68 in the sense that its piston rod 66 enters the cylinder 70, the nozzle front panel 46 can be tilted away from the nozzle back panel 48 into an out-of-operation position in which the jet nozzle 44 is accessible for clean-up and maintenance work. In order to close up the nozzle front panel 46 again, the pressure tube 78 is put under pressure so that the nozzle front panel 48 tilts back again around axis A into its operating position.

A discharge plate 80 which is mounted on the blade beam 24, as well as a return trough 82 that is held on the nozzle front panel 46, catches the excess medium which is removed in the doctoring area 22 and feeds it to a coating medium processing station which is not illustrated in detail here.

Dirt particles or other solids could adhere to the nozzle discharge opening 12 and to an ink supply channel immediately preceding it which is connected to the pre-chamber 42. Thus, the jet 16 emerging from the jet nozzle 44 can be more or less interrupted in the areas of these contaminations, thereby inhibiting or preventing coating of the material web 14. If this trouble source continues for some time, it will manifest itself in the coating profile of the applied layer as streaking, which sometimes is recognizable even with the naked eye. To measure such streaking, a measuring device 86 is provided to examine the coated material web 14 before or after it is dried as to the presence of such streaking. For this purpose, the measuring device 86 conducts reflection and/or opacity measurements on the coated material web 14, whereby it utilizes optosensors on both sides of the material web 14 which are illustrated only in the form of functional blocks. The sensor signals of the measuring device 86 are delivered to a control center 92 through signal lines 88, 90. The measured signals are evaluated in an analyzer 94 which is illustrated only in the form of functional blocks in the control center 92. If the control center 92 detects streak zones of missing coating in the coated material web 14, it will either initiate appropriate corrective measures or signal the result of its examination either optically or audibly to the operator so that measures for defect removal can be initiated. In order to provide a warning signal, the control center 92 may, for example, operate a warning lamp 96 or an audible device 98.

The initiation of the corrective measures or the warning signals is brought about by a controller logic 100 which is again indicated as an additional functional block in the control center 92 and which is coupled with the analyzer logic 94. The analyzer logic 94 and the control logic 100 could be formed by a common process control computer but could also be arranged as separate functional units.

In order to remove the undesired streaking in the coating layer on the material web 14, the control center 92 causes a short term opening of the jet nozzle 44, that is, a short term enlargement of the jet discharge opening 12. For this purpose, the control center 92 is in control contact with the pressure source 54 via a control line (or through a control line bundle) 102. When appropriate control signals are delivered to the pressure supply 54, either the piston-cylinder unit 68 is operated in order to tilt open the nozzle front panel 46, or the pressure supply 54 will operate one or more positioning elements 52 in order to enlarge the opening width of the jet discharge opening 12. In the last mentioned scenario, the specific possibility of a purely local corrective measure exists, since it is possible and sufficient to operate only those positioning elements 52 in whose area the undesired streaking has been observed in the coating profile in the applied layer. By enlarging the jet discharge opening 12, the contamination causing the streaking can be washed out of the jet nozzle 44 so that when the original operating condition is reestablished, a perfect coating result is again achieved. An algorithm may be implemented in the control center 92 according to which the original operating condition is reestablished immediately after opening of the nozzle front panel 46, or immediately after activation of the positioning elements 52, regardless of whether an improved coating result has been observed in the meantime. Nevertheless, it is also possible to make the reestablishment of the original operating condition dependent upon whether an improvement of the coating result has been achieved. In this case, the time span until the nozzle front panel 46 or the positioning elements 52 are reset can become sufficiently long. Specifically, with persistent contaminations, several repeated enlargements of the jet discharge opening 12 may be necessary through repeated opening and closing of the nozzle front panel 46 or repeated activation of the positioning elements 52. The nozzle front panel 46 is closed again through an increase in pressure in the pressure tube 78. A construction configuration is however also possible in which opening and closing of the nozzle front panel 46 is accomplished by use of the piston-cylinder unit 68.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of application of a coating medium onto a moving fiber material web, said method comprising the steps of:

providing an applicator unit having at least one operating parameter;

coating the fiber web with a layer of the coating medium using said applicator unit, each said at least one operating parameter having a corresponding initial operating parameter value at a time of said coating;

examining the layer of coating medium for a deviation from a desired coating result;

correcting the deviation, said correcting step including temporarily modifying at least one of said at least one operating parameters of said applicator unit from said corresponding initial operating parameter value to effect and thereby cause removal of a disturbing factor causing the deviation, said temporary modification occurring with the fiber web moving;

resetting said at least one of said at least one operating parameters approximately to said corresponding initial operating parameter value, said resetting occurring during said application of the coating medium onto the moving fiber material web and after said correcting step;

repeating said coating and examining steps; and repeating said correcting step and said resetting step if said deviation is detected in said repeated examining step.

2. The method of claim 1, wherein said resetting step is dependent upon detecting an at least reduced deviation in said repeated examining step.

3. The method of claim 1, wherein said resetting step is independent from detecting an at least reduced deviation in said repeated examining step.

4. The method of claim 3, wherein said resetting step occurs a predetermined time period after at least one said correcting step.

5. The method of claim 1, wherein said examining step includes examining the fiber web for defective application zones in the layer of coating medium, one of none of the coating medium and an insufficient amount of the coating medium having been applied in said defective application zones.

6. The method of claim 5, wherein said examining of the fiber web is performed optically.

7. The method of claim 6, wherein said optical examination is performed visually, said correcting and resetting steps each being performed manually.

8. The method of claim 6, wherein said optical examination is performed with an optical measuring device producing measured data, said examining step including evaluating said measured data for a presence of said defective application zones.

9. The method of claim 8, wherein said examining step includes conducting an opacity measurement on the coated fiber web with said optical measuring device.

10. The method of claim 8, wherein said examining step includes conducting a reflection measurement on the coated fiber web with said optical measuring device.

11. The method of claim 8, wherein said examining step includes processing said measured data, indicating said measured data with an indicating device, and evaluating said measured data, said correcting and resetting steps being performed manually if said defective application zones are detected.

12. The method of claim 8, wherein said evaluating step includes evaluating said measured data for said presence of said defective application zones with a microprocessor-supported analyzer.

13. The method of claim 12, wherein said evaluating step includes communicating a result evaluated by said analyzer, said correcting and resetting steps being performed manually if said defective application zones in the layer of coating medium have been detected.

14. The method of claim 13, comprising the further step of providing at least one of an optical warning and an audible warning if said defective application zones in the layer of coating medium have been detected.

15. The method of claim 12, including the further step of coupling said analyzer with a control device, said control device causing said correcting and resetting steps if said defective application zones in the layer of coating medium have been detected.

16. The method of claim 1, wherein said applicator unit comprises a free jet applicator having a jet discharge opening, said coating step including directing the coating medium in the form of a jet through said jet discharge opening, said directing of the coating medium being one of directly onto the fiber web and onto a moving transfer surface for indirect application onto the fiber web, said correcting step including adjusting at least one said operating parameter affecting at least one characteristic of the jet.

17. The method of claim 16, wherein said correcting step includes the sequential substeps of:

enlarging an opening cross profile of said jet discharge opening; and reducing said opening cross profile of said jet discharge opening.

18. A method of removing contaminants during an application of a coating medium onto a moving fiber material web, said coating medium being applied with a coating apparatus comprised of an applicator and a doctor element, said method comprising:

applying said coating medium using a standard setting for each of a contact pressure of said doctor element, a flow pressure of said applicator and an opening cross-profile of said applicator;

adjusting the setting of at least one of said contact pressure, said flow pressure, and said opening cross-profile in order to effect and thereby cause removal of contaminants from at least one of said doctor element and said applicator; and upon removal of said contaminants, resetting said at least one of said contact pressure, said flow pressure, and said opening cross-profile substantially to said standard setting thereof during said application of said coating medium onto the moving fiber material web.

19. A method of application of a coating medium onto a moving fiber material web, said method comprising the steps of:

providing a free jet applicator with a jet discharge opening, said jet discharge opening having an opening cross profile, said jet discharge opening including a length and an opening width;

coating the fiber web with a layer of the coating medium using said applicator unit, the opening cross profile having a corresponding initial operating opening cross profile value at a time of said coating;

examining the layer of coating medium for a deviation from a desired coating result;

correcting the deviation, said correcting step comprising temporarily modifying the opening cross profile to thereby remove a disturbing factor causing the deviation, said correcting step including the sequential substeps of enlarging the opening cross profile and reducing said opening cross profile, said enlarging substep including one of increasing the opening width locally in areas of observed deviation from said desired coating result and increasing the opening width substantially across the length of said jet discharge opening, said temporary modification occurring with the fiber web moving;

resetting the opening cross profile approximately to the corresponding initial operating cross profile value, said resetting occurring during said application of the coating medium onto the moving fiber material web and after said correcting step;

repeating said coating and examining steps; and repeating said correcting step and said subsequent resetting step if said deviation is detected in said repeated examining step.

20. An apparatus for application of a coating medium onto a moving fiber material web, said apparatus comprising:

an applicator configured for applying a layer of the coating medium onto the fiber web, said applicator having at least one operating parameter, each said at least one operating parameter having a corresponding initial operating parameter value;

a measuring device configured for obtaining data related to the coated fiber web;

a microprocessor-supported analyzer configured for evaluating said obtained data with regard to a presence of a deviation of a measured coating result from a desired coating result; and a control unit coupled with said analyzer, said control unit being configured for correcting said deviation by sequentially:

at least one of short term and repeated adjustment of at least one of said at least one operating parameters from said corresponding initial operating parameter value to effect and thereby cause removal of a disturbing factor causing the deviation, said adjustment being performed while the fiber web is moving; and resetting said at least one of said at least one operating parameters to approximately said corresponding initial operating parameter value, said resetting occurring during said application of the coating medium onto the moving fiber material web.

21. The apparatus of claim 20, wherein said measuring device includes an optical measuring device configured for conducting optical measurements of the coated fiber web.

22. The apparatus of claim 21, wherein said measurement device is configured for measuring opacity characteristics of the coated fiber web.

23. The apparatus of claim 21, wherein said measurement device is configured for measuring reflective characteristics of the coated fiber web.

24. The apparatus of claim 20, wherein said analyzer is configured for evaluating said obtained data with regard to a presence of zones displaying one of no applied coating medium and insufficient volumes of applied coating medium in the applied layer.

25. The apparatus of claim 20, wherein said applicator comprises a free jet applicator having a jet discharge opening, said free jet applicator being configured for directing a jet of coating medium one of onto the fiber web and onto a moving transfer surface from which the coating medium is transferable to the fiber web.

26. The apparatus of claim 25, wherein said jet has a shape, said control unit being configured for correcting said deviation by adjusting at least one said applicator operating parameter that influences said jet shape.

27. The apparatus of claim 26, wherein said jet discharge opening has a cross profile, said control unit being configured for correcting said deviation by causing a short term enlargement of said cross profile of said jet discharge opening.

28. An apparatus for application of a coating medium onto a moving fiber material web, said apparatus comprising:

a free jet applicator including a jet discharge opening, said jet discharge opening having a cross profile and having a length and an opening width, said free jet applicator being configured for directing a jet of coating medium one of onto the fiber web and onto a moving transfer surface from which the coating medium is transferable to the fiber web, the cross profile having a corresponding initial cross profile value;

a measuring device configured for obtaining data related to the coated fiber web;

a microprocessor-supported analyzer configured for evaluating said obtained data with regard to a presence of a deviation of a measured coating result from a desired coating result; and a control unit coupled with said analyzer, said control unit being configured for correcting said deviation by:

at least one of short term and repeated adjustment of the cross profile from the corresponding initial operating cross profile value to thereby remove a disturbing factor causing the deviation, initiation of short term enlargement of the cross profile in one of local areas of said deviation of a measured coating result from a desired coating result and substantially along the length of said jet discharge opening, said adjustment being performed while the fiber web is moving; and resetting the cross profile to approximately the corresponding initial cross profile value during said application of the coating medium on the fiber material web.

* * * * *